United States Patent [19]

Butterfield

[11] Patent Number: 4,965,707

[45] Date of Patent: Oct. 23, 1990

[54] APPARATUS FOR SIMULATING FLAMES

[75] Inventor: Brian J. Butterfield, Dublin, Ireland

[73] Assignee: Basic Engineering Ltd., Eire, Ireland

[21] Appl. No.: 478,151

[22] Filed: Feb. 5, 1990

[30] Foreign Application Priority Data

Feb. 10, 1989 [GB] United Kingdom ..... 8921001

[51] Int. Cl.[5] ..... F21V 33/00

[52] U.S. Cl. ..... 362/96; 362/92; 362/806; 40/428; 272/8 F; 392/348

[58] Field of Search ..... 362/92, 96, 806; 40/428, 439; 219/344; 272/8 F, 15

[56] References Cited

U.S. PATENT DOCUMENTS

| | | | |
|---|---|---|---|
| 1,824,388 | 9/1931 | Birch | 362/96 |
| 3,395,475 | 8/1968 | Moss | 40/428 |
| 3,603,013 | 9/1971 | Reed et al. | 40/428 |
| 3,742,189 | 6/1973 | Conroy et al. | 40/428 |
| 4,890,600 | 1/1990 | Meyers | 362/806 |

*Primary Examiner*—Stephen F. Husar
*Assistant Examiner*—Richard R. Cole
*Attorney, Agent, or Firm*—Nixon & Vanderhye

[57] ABSTRACT

Simulated flame effect means, such as suspended ribbons moved by a forced stream of air from a fan, receive light from a source which is then reflected onto a diffusing screen. The screen, which is both transparent and partly reflective, is situated in front of means for simulating combusting fuel. The light reflected by the flame effect means, which gives the appearance of flames, thereby appears to emanate between the simulated fuel and its image reflected in the screen.

19 Claims, 3 Drawing Sheets

APPARATUS FOR SIMULATING FLAMES

Figure 2:
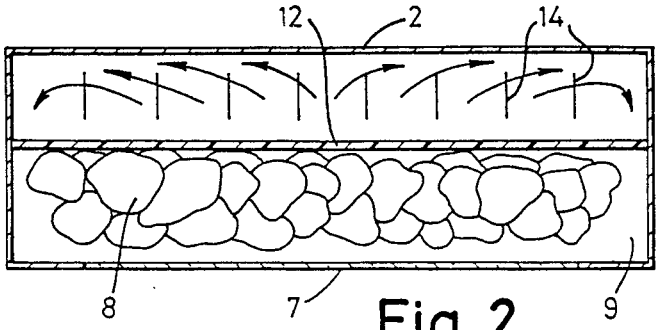

This invention relates to apparatus for simulating flames. The apparatus may be part of, or embodied in a heating appliance (such as an electric or gas fire) in order to create the impression of flames due to combusting fuel.

Many attempts have been made in the past to simulate combusting fuel. The prior art devices often included some means intended to represent flickering flames but they lacked realism. Moreover, when an appliance having such an effect is seen from day to day, it becomes less convincing with the passage of time. In many prior art devices, dust and dirt can also build up on various surfaces so that any initially pleasing effect is spoilt thereby detracting from any realism. At least the preferred embodiments of the invention seek to solve these problems.

The invention provides apparatus for simulating flames, the apparatus comprising a source of light, simulated flame effect means for reflecting said light to simulate flames, simulated fuel means to simulate a bed of combusting fuel, and screen means on which to view an image of the simulated flames, said screen means being positioned between said flame effect means and said simulated fuel means, said screen means being capable of diffusely transmitting light reflected by said flame effect means and also being capable of reflecting light from said simulated fuel means so that the simulated flames appear to emanate between said simulated fuel means and an image of the latter means reflected in said screen means.

Preferably, the apparatus is mounted in a casing having a transparent front panel through which the simulated fuel and the screen are visible. This helps to exclude dust and dirt. Preferably, the flame effect means is sealed against the ingress of dust and dirt.

Preferably, the flame effect means comprises pieces of material supported in such a way that they move in response to a current of air provided, for example, by a small fan. In a preferred embodiment of the invention, ribbons of material extend between spaced supports and the ribbons are supported in such a manner so as to promote their movement due to the current of air. The ribbons may be made of silk, satin or a similar fabric which reflects light and tends to undulate in an air stream so as to provide a constantly changing reflecting surface similar to the appearance of a flame. Such ribbons are preferably suspended or held in a substantially vertical orientation. They can be suspended or held substantially edgewise to the screen means or they can be twisted so that e.g. a lower portion of each ribbon is edgewise to the screen means whilst an upper portion is substantially parallel to the screen means. They may also be shaped to improve the realism of the effect, for example, they may be triangular, or trapezoidal, or other shapes which tend to imitate the shape of a flame and/or increase its movement e.g. with ragged or curling edges, and they may also have slits or holes to promote this effect. The ribbons can also be coated with material to improve their reflectivity.

Preferably, the screen means includes one or more panels. For example, a single panel may be used which is made so that it partly transmits, partly reflects and also diffuses light. More specifically, a single panel may have a partly or lightly silvered front surface to reflect light and its rear surface treated so as to diffuse light. In any event, the partially reflective property is such as to reflect light from the simulated fuel bed so that the simulated flames appear to emanate from a position between the simulated fuel and its reflection in the screen. This considerably improves the realism of the simulated flames and is surprisingly effective. The diffusing action of the screen is such as to prevent the ribbons (or their equivalent) from being seen too clearly through the screen whilst at the same time allowing sufficient light therethrough (reflected from the ribbons) to give the simulated flame effect. This kind of diffusion may be provided by a surface having closely spaced lines and such a surface may be part of a single panel which is also partly reflective. Alternatively, it can be part of a separate panel. Such a diffusing effect also tends to create a magnified image due to refraction. The lines may be spaced at about 1,000 lines to the cm. and they can be horizontal (as viewed), or cross-hatched.

An alternative screen means has a clear or transparent panel (e.g. of glass) mounted closely adjacent a diffusing panel (e.g. of heat resistant plastics). Suitably, the diffusing panel is matt on the side immediately opposite the transparent panel. Suitably, a diffusing panel is made of material which usually has two polished or shiny sides and one side is made matt by e.g. abrasion. A suitable panel can be made from polycarbonate (available under the Trade Mark "Lexan".) When such a screen is used, the transparent panel acts partly as a reflector for light received either directly from the simulated fuel means, or indirectly from the latter means after at least one reflection from the transparent front panel which is preferably partly silvered to promote such reflection. The transparent panel directly transmits the light received from the flame effect means and the diffusing action softens the edges of the images of the ribbons.

In a preferred embodiment of the invention, the flame effect means is positioned closely adjacent, but not touching the screen means. More generally, the flame effect means is preferably positioned at a distance from the screen means (on one side) which does not exceed the amount by which the simulated fuel bed extends away from the screen means (on the other side).

Where a front panel is provided for enclosing a casing containing the apparatus, the front panel may be tinted so that the means for simulating flames and combusting fuel are not visible when the light source is extinguished However, a clear sheet may be used where this effect is not required. In either case, the front panel may be partly or lightly silvered so that it is both reflective and transparent whereby the simulated fuel bed appears to extend more deeply into the back of the fire (due to multiple front-to-back reflections between confronting surfaces of the screen means and the front panel) and the simulated flames appear to emanate from different regions in the extended fuel bed.

Figure 1:
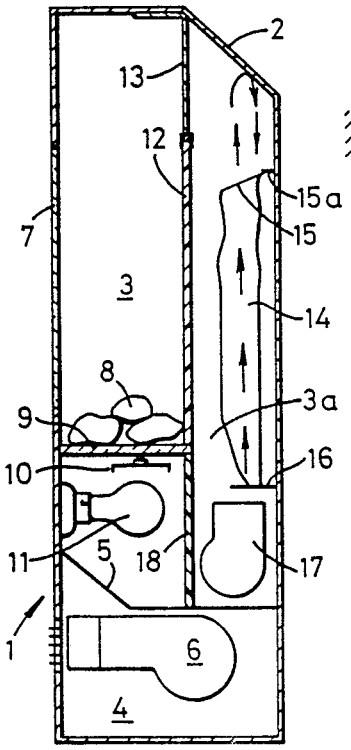
Figure 3A:
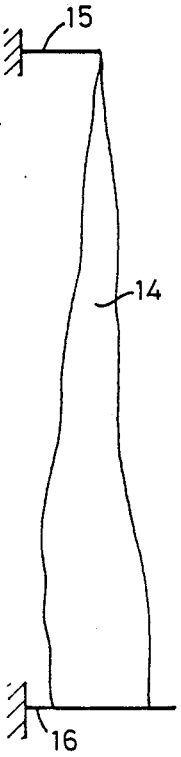
Figure 3B:
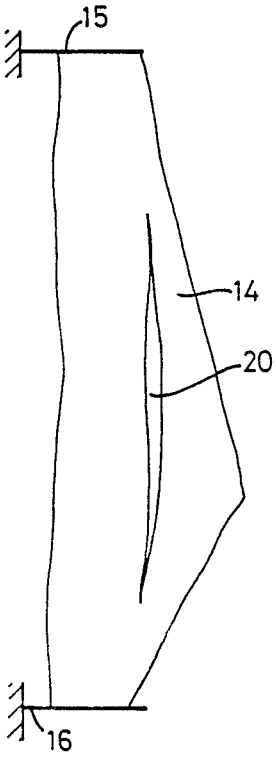
Figure 5:
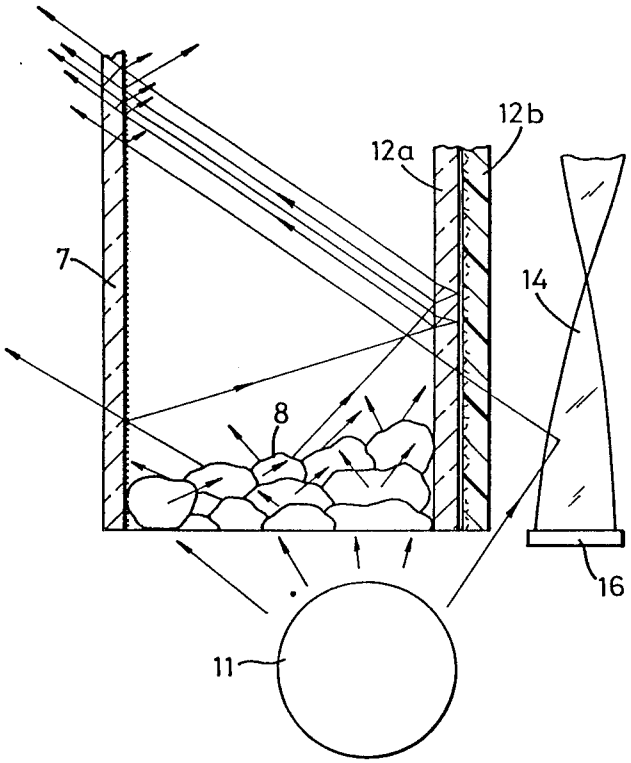
Figure 4:
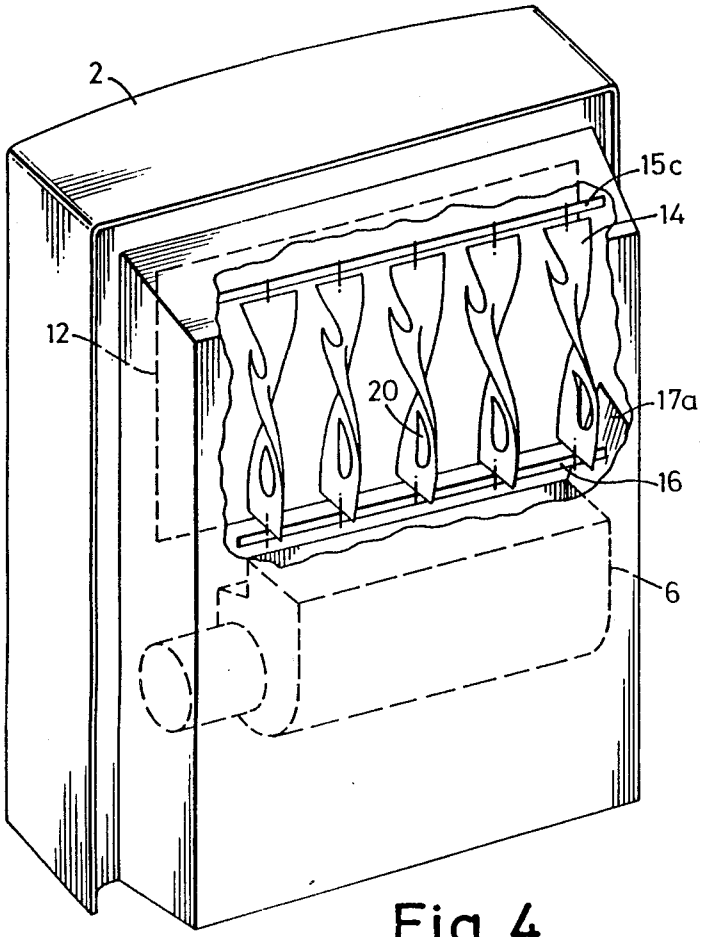
Figure 7:
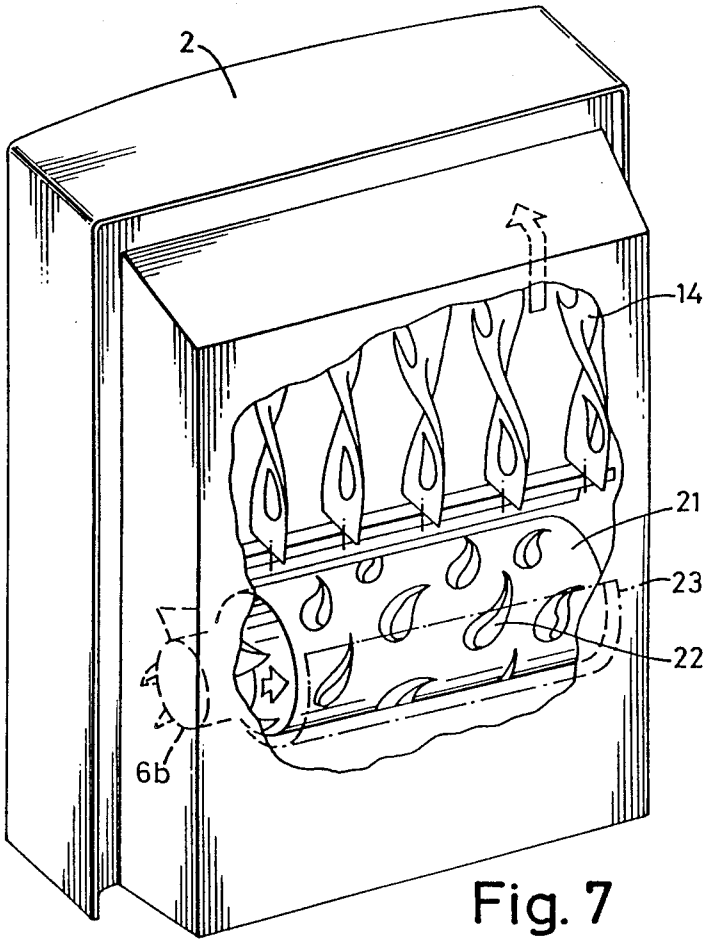
Figure 6:
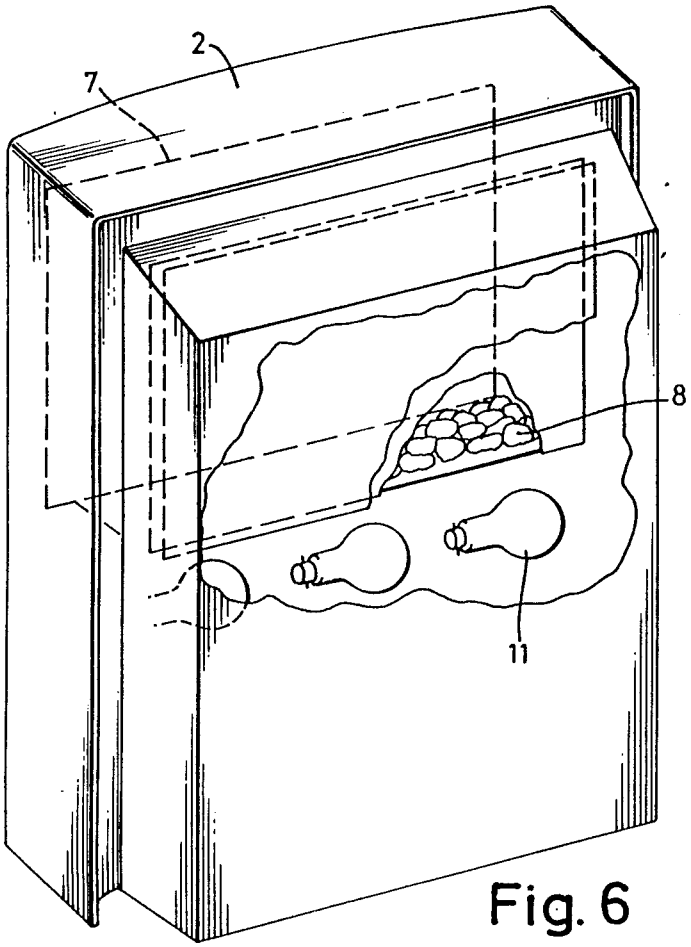

An embodiment of the invention will now be described with reference to the accompanying schematic Drawings, in which:

FIG. 1 is a side elevation, in section, of a heating appliance embodying apparatus according to the invention, FIG. 2 is a plan view, in section, of the appliance shown in FIG. 1, FIGS. 3*a* and 3*b* illustrate ribbons of different shapes, FIGS. 4, 5 and 6 show a different embodiment, and FIG. 7 shows a modification to FIG. 6.

Referring to the Drawings, a heating appliance comprises a casing 2 having a main upper compartment 3 and a main lower compartment 4 divided by a partition 5. The lower chamber 4 contains any suitable means for providing a thermal output, for example a forced air convection unit 6 generally comprising an electric heating element and a fan for passing an air stream over the element. As such heating means are known in the art, no further details need be given.

Compartment 3 includes a sealed chamber 3*a* and it is closed, at the front, by a transparent and preferably tinted panel 7. This panel may be made of glass (e.g. so-called smoked glass) or plastics, e.g. acrylic or perspex. Chamber 3 contains means 8 for simulating a bed of fuel. Such means preferably comprise pieces of coloured glass supported on a diffusing screen 9, e.g. a sheet of frosted or translucent glass. A pivotally mounted light fan or flicker wheel !0 is mounted beneath the diffusing sheet 9 and over an electric lamp 11 secured to casing 2. The fan 10 is a generally circular element with reflective vanes driven by thermal currents rising from the lamp 11 when the lamp is switched on. Such an arrangement is generally known in the art for producing a flickering effect whereby intermittent beams of light can be made to fall on the pieces of glass 8 at different angle of incidence. This causes the simulated fuel bed 8 to resemble glowing coals.

A screen 12 extends upwardly from the simulated fuel bed 8 towards the upper part of casing 2. Screen 12 may be one or more panels having a partially reflecting surface and a diffusing surface. Suitably, screen 12 is made from a sheet of transparent material, such as glass, acrylic or perspex, having a lightly silvered surface on its front side (i.e. facing the front panel 7) and having, on its rear side, a surface on which closely spaced lines have been scored or otherwise produced. For example, the lines may be photographically produced on the rear surface. The lines may be horizontal, or inclined, or cross-hatched, in order to provide a suitable diffusing effect. Screen 12 is preferably joined to a wall 13 which seals the screen 12 to the casing 2, e.g. in an airtight fashion, to prevent the ingress of dust.

Behind the screen 12, means are provided for simulating a flame effect. Such means comprise a series of ribbons 14, each of which is suspended from a thread 15 attached to an anchor point 15*a*. The bottom of each ribbon 14 is attached to a respective pin 16 which is fixed to the rear panel of the casing 2. The ribbons !4 hang in a substantially vertical and spaced relationship as best seen in the plan view of FIG. 2. They are not taut, but somewhat slack, so that the ribbons !4 tend to ripple or undulate in a current of air provided by a small tangential fan unit !7 which is situated below the lower ends of the ribbons 14 and which extends across most of the lower portion of the otherwise substantially airtight chamber 3*a*. As mentioned above, wall 13 seals the upper part of the screen to the casing 2. There is also provided a transparent wall 18, adjacent the lamp housing, for sealing chamber 3*a* in an airtight fashion. The space in which the ribbons 14 and the fan unit 17 are located is thereby totally sealed against the ingress of dust and this helps to maintain the reflective surfaces of ribbons 14 in good order so that the simulated flame effect does not rapidly deteriorate with use and age.

Ribbons 14 are preferably made of silk or synthetic silk-like material and/or they may be made of material having a similar 'hang' to silk but coated (if necessary) to improve their reflectivity. The ribbons may be shaped so that they are each tapered at their lower end (attached to pin 16) or they may be of a shape as shown in either FIG. 3*a*, or FIG. 3*b*. A sail-like shape helps to promote the appearance of a flame both from its shape and its mobility. The slit 20, shown in FIG. 3*b*, tends to promote a curling, rippling movement, in the current air produced by fan 17, thereby improving the visual effect. In practice, the ribbons 14 appear to twist and ripple along their edges and this gives the appearance of a flame shooting up the back of the fire (i.e. as if it were passing towards a chimney), the slit 20 separating portions of the ribbon so as to simulate forked flame (which tends to twist, flash and vanish due to jets of gas produced by burning coals).

Although the fan unit 17 is completely sealed in chamber 3*a*, there are small gaps at the sides of the outermost ribbons into which the airstream flows. The strongest current of air passes centrally up the ribbon array and after impinging on the upper wall of the casing 2, the air passes down each side of the casing (adjacent the outermost ribbons) before returning to the fan inlet. Since the flow of air is strongest in the centre of the ribbon array, the central ribbons tend to ripple more than the outer ribbons and this tends to imitate, more closely, an actual bed of burning fuel.

As an alternative to using the sealed chamber 3*a* shown in FIG. 1, the ribbons can be suspended from a partition (not shown) spaced away from the rear wall of casing 2 so that the air (from fan 17) first passes up the length of the ribbons, then impinges on the top of casing 2, before passing over the top of the partition and down its rear surface in order to return to the fan inlet However, the sealed chamber described above provides a particularly realistic effect without the need to use a partition to provide a loop of air.

When the lamp 11 is switched on, the simulated fuel bed is illuminated and the partially reflective surface of screen 12 provides an image of the fuel bed. The fan 17 creates undulating movement of the ribbons 14 and light from lamp 11 is therefore reflected randomly onto the back of screen 12 so as to simulate flickering flames. This flickering image is perceived between the actual simulated fuel bed 8 and its image in the screen 12 so that the flames appear to be emanating from somewhere in the middle of an extended fuel bed.

Whilst it is preferable that the flame effect means (14, 17) is totally sealed in the rear part of chamber 3, i.e. to prevent the ingress of dust, vents (not shown) could be provided both adjacent the fan unit 17 and adjacent the top of the casing 2 (e.g. in the walls 13 and 18) to provide a single stream of air.

Various modifications may be made to the heating appliance shown in FIGS. 1 and 2. For example, known power control means (such as that used in a dimmer switch may be connected to the lamp 11 to enable its power supply to be varied, thereby causing a change in its temperature and hence a variation in the speed of rotation of the flicker fan 10. Similar means may be used to control the power supply to the fan unit 17 so as to vary its speed and hence the flow of air over the ribbons 14. Such controls may be independent, or combined and, in either case, connected to a control knob which is adjustable by a user. Such a control or controls may also be coupled to known means for adjusting the thermal output of the heating device, e.g. the forced air fan heater 6 shown in FIG. 1. The arrangement may be such that the simulated flame effect imitates the rate of heat dissipated by the appliance, i.e. as though the (simulated) fuel were burning at a faster or slower rate. Thus, the lamp 11 is made brighter and the ribbons are caused to undulate faster to represent a higher combustion rate corresponding to a higher thermal output.

FIGS. 4, 5 and 6 show a different embodiment in which the following modifications have been made. The ribbons I each have a single twist so that a lower portion of each ribbon is substantially perpendicular to screen !2 and a upper portion is substantially parallel to the screen 12. Moreover, the edges of each ribbon are jagged or cut to form curling shapes and leaf shaped cut-outs 20 are provided which together promote the flame effect. The ribbons 14 are suspended or held between an upper bracket 15*c* fixed to the casing and a lower bracket 16 which is also fixed to the casing so that the twist in each of the ribbons 14 is suitably maintained. In this embodiment, as seen more clearly in the side sectional elevation of FIG. 5, the screen 12 includes a front transparent glass panel 12*a* which is closely adjacent, e.g. touching, a rear diffusing panel 12*b*. Panel 12*b* is made from heat resistant plastics material such as polycarbonate which is of an opal shade so as to diffuse light passing therethrough. Sheets of such material are normally provided with shiny major surfaces and one of these is suitably abraded to provide a matt finish. The matt side of panel 12*b* is placed against the transparent panel 12*a*. The transparent panel 12*a* transmits light from the diffusing panel 12*b* but also acts as a reflector for light received from the simulated fuel bed 8 either directly, or after reflection from the partly silvered rear surface of the front panel 7. In FIG. 4, a tangential fan 6 is shown similar to that shown in FIG. 1 but side wings 17*a* may be provided to improve the efficiency of air flow and to create eddies to stimulate the outermost ribbons to improve the simulation of flickering flames. FIG. 6 shows the source of light for illuminating the simulated fuel bed 8 and in this case the light is provided by three tinted bulbs which may, or may not, be provided with pivotally mounted light fans or flicker wheels to produce moving beams of light.

Since the arrangement shown in FIG. 4 may produce a somewhat predictable flutter of the ribbons 14, the improvement shown in FIG. 7 may be employed for a more random flame effect.

In FIG. 7 a propeller fan 6*b* blows air axially into a light cylinder 21 which is mounted on an axle (not shown) for rotation by means of the air current. The cylinder 21 is perforated by a number of non-geometric holes 22, e.g. various leaf shapes, which are bounded or partly bounded by tabs which are formed to divert the air flow from the fan 6*b* and thereby turn the cylinder 21 on its axle. A semicircular mask 23 is also fitted so that the air from the fan 6*b* does not simply extend outwardly and evenly in radial directions but is confined to escaping from the holes which are not partly blanked by the mask 23. This tends to direct air upwardly towards the ribbons as well as to promote rotation of the cylinder 21. Fan 6*b* and fan 6 may both draw air from an inlet grille at the lower front face of the housing in which the apparatus is installed. Alternatively, some form of closed circulating system may be used to reduce the effect of dust and thereby to maintain the simulated flame effect in good order during the lifetime of the appliance.

Other modifications or improvements may be made without departing from the scope of the invention.

The scope of the invention is defined by the following claims appended hereto:

I claim:

1. Apparatus for simulating flames, the apparatus comprising a source of light, simulated flame effect means for reflecting said light to simulate flames, simulated fuel means to simulate a bed of combusting fuel, and screen means on which to view an image of the simulated flames, said screen means being positioned between said flame effect means and said simulated fuel means, said screen means being capable of diffusely transmitting light reflected by said flame effect means and also being capable of reflecting light from said simulated fuel means so that the simulated flames appear to emanate between the simulated fuel means and an image of the latter means reflected in said screen means.

2. Apparatus according to claim 1 wherein said flame effect means comprises pieces of material supported so that they are capable of movement, and means for causing said movement.

3. Apparatus according to claim 2 wherein said material is in the form of a plurality of ribbons extending between spaced supports.

4. Apparatus according to claim 3 in which each of said ribbons is twisted.

5. Apparatus according to claim 3 wherein the means for causing said movement generates a current of air.

6. Apparatus according to claim 5 wherein said means for causing movement includes an electric fan and a cylinder mounted for rotation by the air stream generated by the fan the cylinder being provided with air deflection means for imparting a more random movement to said ribbons to improve the simulated flame effect.

7. Apparatus according to claim 3, wherein said ribbons are shaped in such a way as to imitate the shape of a flame and/or to increase their movement.

8. Apparatus according to claim 7 wherein said lines are horizontal, inclined, or cross-hatched.

9. Apparatus according to claim 1 wherein said screen means is a translucent or transparent panel or panels having a reflective surface and a diffusing surface.

10. Apparatus according to claim 1 in which said screen means is a single panel having a lightly reflective front surface and a rear surface on which are provided a multiplicity of closely spaced lines.

11. Apparatus according to claim 1 said screen means comprises a transparent panel situated closely adjacent a diffusing panel.

12. Apparatus according to claim 1 mounted in or forming part of a casing having a transparent front panel through which the simulated fuel and the screen means are visible.

13. Apparatus according to claim 12 wherein said transparent front panel is tinted so that the simulated fuel and the screen means are substantially obscured when the source of light is extinguished.

14. Apparatus according to claim 12 or 13 wherein the front panel is both transparent and reflective whereby multiple front-to-back images of the simulated fuel means are provided and the simulated flames appear to emanate from different regions in an extended bed of fuel.

15. Apparatus for simulating flames, the apparatus comprising:

(a) a light source, (b) flame effect means, said flame effect means including a plurality of ribbons for simulating flames, means supporting the ribbons in a substantially vertical-spaced relationship, said supporting means enabling the ribbons to move in response to a current of air, and means to provide said air current, (c) screen means having a partially reflecting surface and a diffusing surface, said ribbons extending adjacent an inner side of said screen means whereby light reflected from the ribbons produces an image on the screen means which simulates moving flames, and (d) simulated fuel means located adjacent an outer side of said screen means and provided to simulate a bed of combusting fuel, the outer side of the screen means having a partially reflective surface whereby an image of the simulated fuel means is visible on the screen means, the arrangement being such that the simulated flames appear to emanate between the simulated fuel means and its image in the screen means.

16. Apparatus according to claim 15 wherein the flame effect means are sealed in a chamber to prevent the ingress of dust, the means providing said air current being a fan having an outlet extending across a major extent of the ribbons so that air passes upwardly between the ribbons and downwardly adjacent the outermost ribbons before returning to the fan.

17. Apparatus according to claim 15 wherein said screen means is a single panel having a partially reflective front surface and a rear surface on which are provided a multiplicity of closely spaced lines.

18. Apparatus according to claim 15 wherein said screen means comprises a transparent panel closely adjacent a diffusing panel.

19. Apparatus according to claims 15 wherein the means providing said air current includes baffles and/or air directing means for introducing a substantially random effect to the movement of the ribbons for improving the simulated flame effect.

* * * * *